US010115367B2

(12) United States Patent
Zhang et al.

(10) Patent No.: US 10,115,367 B2
(45) Date of Patent: Oct. 30, 2018

(54) DRIVING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventors: Xianming Zhang, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 365 days.

(21) Appl. No.: 14/905,805

(22) PCT Filed: Sep. 9, 2015

(86) PCT No.: PCT/CN2015/089263

§ 371 (c)(1),
(2) Date: Jan. 16, 2016

(87) PCT Pub. No.: WO2017/028347

PCT Pub. Date: Feb. 23, 2017

(65) Prior Publication Data

US 2017/0236486 A1 Aug. 17, 2017

(30) Foreign Application Priority Data

Aug. 19, 2015 (CN) ..... 2015 1 0511114

(51) Int. Cl.
*G09G 3/36* (2006.01)

(52) U.S. Cl.
CPC ..... *G09G 3/3696* (2013.01); *G09G 3/3677* (2013.01)

(58) Field of Classification Search
None
See application file for complete search history.

(56) References Cited

U.S. PATENT DOCUMENTS 6,894,461 B1 * 5/2005 Hack ..... G05F 1/70 307/82
2007/0085803 A1 * 4/2007 Chu ..... G09G 3/3611 345/98

(Continued)

FOREIGN PATENT DOCUMENTS

CN 1953036 A 4/2007
CN 101329851 A 12/2008

(Continued)

*Primary Examiner* — Kumar Patel
*Assistant Examiner* — Amy C Onyekaba
(74) *Attorney, Agent, or Firm* — Andrew C. Cheng

(57) ABSTRACT

The present invention discloses a driving circuit and a liquid crystal display device. The driving circuit has: a first to fourth diodes, a first and second capacitors, and an adjustable voltage source, An anode of the first diode inputs a voltage, cathodes of the first to third diodes are connected to anodes of the second to fourth diodes, a cathode of the fourth diode outputs a voltage, a first end of the first capacitor is connected to a common end of the first diode and the second diode, a second end of the first capacitor is connected to an output terminal of the adjustable voltage source, and a selective terminal thereof is used to input a selective voltage; when an input voltage is not changed, the selective voltage is different and an output voltage is different. The above-mentioned method can provide multiple different output voltages to meet with client's requirements.

5 Claims, 2 Drawing Sheets

(56) References Cited

U.S. PATENT DOCUMENTS

| | | | | |
|---|---|---|---|---|
| 2007/0085806 | A1* | 4/2007 | Moon | G09G 3/3611 345/98 |
| 2008/0054987 | A1* | 3/2008 | Choi | G09G 3/3696 327/512 |
| 2008/0062100 | A1* | 3/2008 | Hong | G09G 3/3696 345/87 |
| 2008/0309597 | A1* | 12/2008 | Nam | G09G 3/3677 345/87 |
| 2017/0012532 | A1* | 1/2017 | Tago | H02M 3/158 |

FOREIGN PATENT DOCUMENTS

| | | | |
|---|---|---|---|
| CN | 201766503 | U | 3/2011 |
| CN | 102543022 | A | 7/2012 |
| CN | 103178716 | A | 6/2013 |
| KR | 100490045 | B1 | 5/2005 |

* cited by examiner

DRIVING CIRCUIT AND LIQUID CRYSTAL DISPLAY DEVICE

CROSS-REFERENCE TO RELATED APPLICATIONS

This application claims the priority of Chinese Patent Application No. 201510511114.7, entitled "driving circuit and liquid crystal display device", filed on Aug. 19, 2015, the disclosure of which is incorporated herein by reference in its entirety.

FIELD OF THE INVENTION

The present invention relates to a liquid crystal display field, and more particularly to a driving circuit and liquid crystal display device.

BACKGROUND OF THE INVENTION

As shown in FIG. 1, a conventional technology provides a driving circuit comprising a first diode D1, a second diose D2, a third diode D3, a fourth diode D4, a first capacitor C1, a second capacitor C2, a third capacitor C3, a fourth capacitor C4 and an input voltage source V1. Wherein, an anode of the first diode D1 is used to input a voltage VAA, a cathode of the first diode D1 is connected to an anode of the second diode D2, a cathode of the second diode D2 is connected to an anode of the third diode D3, a cathode of the third diode D3 is connected to an anode of the fourth diode D4, a cathode of the fourth diode D4 is used to output a voltage VGH, a first end of the first capacitor C1 is connected to a common end of the first diode D1 and the second diode D2, a second end of the first capacitor C1 is connected to a first end of the input voltage source V1, a second end of the input voltage source V2 is connected to ground, a first end of the second capacitor C2 is connected to a common end of the second diode D2 and the third diode D3, a second end of the second capacitor C2 is connected to the ground, a first end of the third capacitor C3 is connected to a common end of the third diode D3 and the fourth diode D4, a second end of the third capacitor C3 is connected to the first end of the input voltage source V1, a first end of the fourth capacitor C4 is connected to a cathode of the fourth diode C4 and a second end of the fourth capacitor C4 is connected to the ground.

Under an idea condition, a relationship between the input voltage VAA and the output voltage VGH is: VGHF=VAA+2*V1. It can understand that the output voltage VGH is fixed and cannot satisfy the requirements of use.

SUMMARY OF THE INVENTION

The technical issue that the embodiment of the present invention solves is to provide a driving circuit and a liquid crystal display device and can provide various output voltages.

The present invention provides a driving circuit, comprising: a first diode, a second diose, a third diode, a fourth diode, a first capacitor, a second capacitor and an adjustable voltage source, wherein, the adjustable voltage source comprises multiple field-effect transistors (FET), an anode of the first diode is used to input a voltage, a cathode of the first diode is connected to an anode of the second diode, a cathode of the second diode is connected to an anode of the third diode, a cathode of the third diode is connected to an anode of the fourth diode, a cathode of the fourth diode is used to output a voltage, a first end of the first capacitor is connected to a common end of the first diode and the second diode, a second end of the first capacitor is connected to an output terminal of the adjustable voltage source, and a selective terminal of the adjustable voltage source is used to input a selective voltage; when an input voltage is not changed, the selective voltage is different and an output voltage is different, wherein, the first capacitor and the second capacitor are non-adjustable capacitors.

Selectively, the adjustable voltage source comprises three FETs including a first FET, a second FET and a third FET, a gate of the first FET is used to input a first voltage, a drain of the first FET is connected to a common end of the second end of the first capacitor and a second end of the first capacitor and a source of the first FET is used to input a first selective voltage, a gate of the second FET is used to input a second voltage, a drain of the second FET is connected to the common end of the second ends of the first and second capacitors and a source of the second FET is used to input a second selective voltage, a gate of the third FET is used to input a third voltage, a drain of the third FET is connected to the common end of the second ends of the first and second capacitors and a source of the third FET is used to input a third selective voltage.

Selectively, when the first selective voltage is a BOOST voltage of a pulse width modulation chip, the output voltage is 16V; when the second selective voltage is a 3.3V Buck line voltage of the pulse width modulation chip, the output voltage is 12V; and when the third selective voltage is a 1.2V Buck line voltage of the pulse width modulation chip, the output voltage is 3.3V.

The present invention provides a driving circuit, comprising: a first diode, a second diose, a third diode, a fourth diode, a first capacitor, a second capacitor and an adjustable voltage source, wherein, the adjustable voltage source comprises multiple FETs, an anode of the first diode is used to input a voltage, a cathode of the first diode is connected to an anode of the second diode, a cathode of the second diode is connected to an anode of the third diode, a cathode of the third diode is connected to an anode of the fourth diode, a cathode of the fourth diode is used to output a voltage, a first end of the first capacitor is connected to a common end of the first diode and the second diode, a second end of the first capacitor is connected to an output terminal of the adjustable voltage source, and a selective terminal of the adjustable voltage source is used to input a selective voltage; when an input voltage is not changed, the selective voltage is different and an output voltage is different, wherein, the first capacitor and the second capacitor are non-adjustable capacitors.

Selectively, the adjustable voltage source comprises multiple FETs.

Selectively, the adjustable voltage source comprises three FETs including a first FET, a second FET and a third FET, a gate of the first FET is used to input a first voltage, a drain of the first FET is connected to a common end of the second end of the first capacitor and a second end of the first capacitor and a source of the first FET is used to input a first selective voltage, a gate of the second FET is used to input a second voltage, a drain of the second FET is connected to the common end of the second ends of the first and second capacitors and a source of the second FET is used to input a second selective voltage, a gate of the third FET is used to input a third voltage, a drain of the third FET is connected to the common end of the second ends of the first and second capacitors and a source of the third FET is used to input a third selective voltage.

Selectively, when the first selective voltage is a BOOST voltage of a pulse width modulation chip, the output voltage is 16V; when the second selective voltage is a 3.3V Buck line voltage of the pulse width modulation chip, the output voltage is 12V; and when the third selective voltage is a 1.2V Buck line voltage of the pulse width modulation chip, the output voltage is 3.3V.

Selectively, the first capacitor and the second capacitor are non-adjustable capacitors.

The present invention provides a liquid crystal display panel. The liquid crystal display panel comprises a driving circuit and the driving circuit comprises: a first diode, a second diose, a third diode, a fourth diode, a first capacitor, a second capacitor and an adjustable voltage source, wherein, the adjustable voltage source comprises multiple FETs, an anode of the first diode is used to input a voltage, a cathode of the first diode is connected to an anode of the second diode, a cathode of the second diode is connected to an anode of the third diode, a cathode of the third diode is connected to an anode of the fourth diode, a cathode of the fourth diode is used to output a voltage, a first end of the first capacitor is connected to a common end of the first diode and the second diode, a second end of the first capacitor is connected to an output terminal of the adjustable voltage source, and a selective terminal of the adjustable voltage source is used to input a selective voltage; when an input voltage is not changed, the selective voltage is different and an output voltage is different, wherein, the first capacitor and the second capacitor are non-adjustable capacitors.

Selectively, the adjustable voltage source comprises multiple FETs.

Selectively, the adjustable voltage source comprises three FETs including a first FET, a second FET and a third FET, a gate of the first FET is used to input a first voltage, a drain of the first FET is connected to a common end of the second end of the first capacitor and a second end of the first capacitor and a source of the first FET is used to input a first selective voltage, a gate of the second FET is used to input a second voltage, a drain of the second FET is connected to the common end of the second ends of the first and second capacitors and a source of the second FET is used to input a second selective voltage, a gate of the third FET is used to input a third voltage, a drain of the third FET is connected to the common end of the second ends of the first and second capacitors and a source of the third FET is used to input a third selective voltage.

Selectively, when the first selective voltage is a BOOST voltage of a pulse width modulation chip, the output voltage is 16V; when the second selective voltage is a 3.3V Buck line voltage of the pulse width modulation chip, the output voltage is 12V; and when the third selective voltage is a 1.2V Buck line voltage of the pulse width modulation chip, the output voltage is 3.3V.

Selectively, the first capacitor and the second capacitor are non-adjustable capacitors.

With implementing the embodiment of the present invention, the output terminal can provide the different output voltages by inputting different voltages to the adjustable voltage source to meet with various client's requirements. And, different driving currents are provided by adjusting the voltages. When a large current is required to drive, the output voltage can be decreased to increase a current-driven capability.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF THE PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
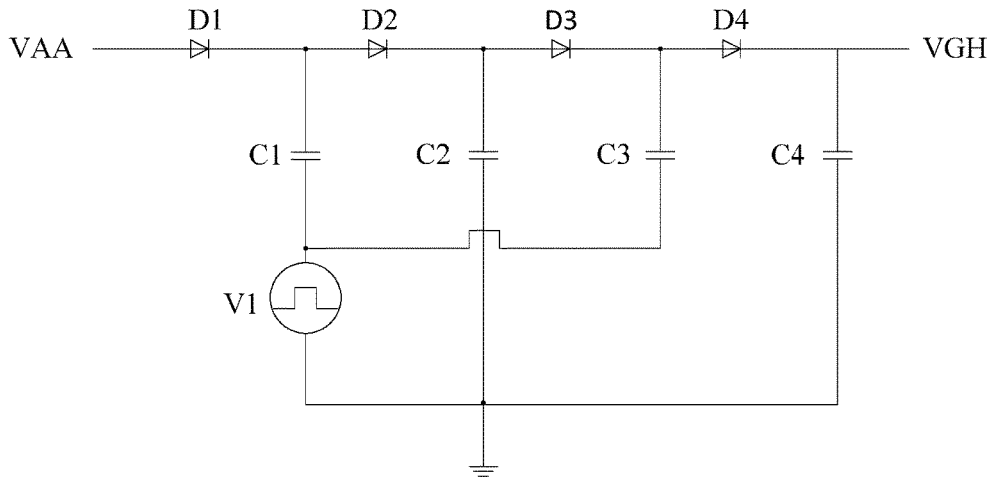
FIG. 1 (PRIOR ART)
FIG. 1 is a circuit diagram of a conventional driving circuit of the prior art.
Figure 2:
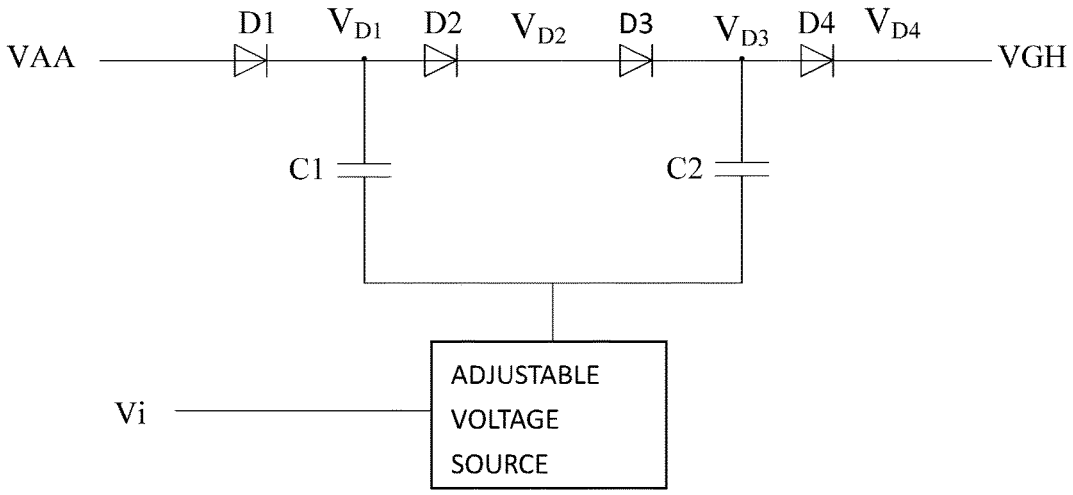
FIG. 2 is a circuit diagram of a driving circuit of the present invention.

Please refer to FIG. 2. FIG. 2 is a circuit diagram of a driving circuit of an embodiment of the present invention. The driving circuit of the present embodiment comprises: a first diode D1, a second diose D2, a third diode D3, a fourth diode D4, a first capacitor C1, a second capacitor C2 and an adjustable voltage source Vi. Wherein, an anode of the first diode D1 is used to input a voltage, a cathode of the first diode D1 is connected to an anode of the second diode D2, a cathode of the second diode D2 is connected to an anode of the third diode D3, a cathode of the third diode D3 is connected to an anode of the fourth diode D4, a cathode of the fourth diode D4 is used to output a voltage, a first end of the first capacitor C1 is connected to a common end of the first diode D1 and the second diode D2, a second end of the first capacitor C1 is connected to an output terminal of the adjustable voltage source Vi, a selective terminal of the adjustable voltage source Vi is used to input a selective voltage. When the selective voltage is different, the adjustable voltage source Vi outputs pulse width modulation voltages with different duty ratios.

In a first stage, the adjustable voltage source Vi is a low voltage level, at the time, the first diode D1, the second diode D2, the third diode D3 and the fourth diode D4 are turned on, and voltages VD1, VD2, VD3, VD4 outputted from the first diode D1, the second diode D2, the third diode D3 and the fourth diode D4 are VAA.

In a second stage, the adjustable voltage source Vi is a high voltage level, the first diode D1 is turned off, the second diode D2, the third diode D3 and the fourth diode D4 are turned on, and the voltages VD1, VD2, VD3, VD4 outputted from the first diode D1, the second diode D2, the third diode D3 and the fourth diode D4 are Vi+VAA.

In a third stage, the adjustable voltage Vi is the low voltage level, at the time, the first diode D1 and the third diode D3 are turned on, the second diode D2 and the fourth diode D4 are turned off, the voltage VD1 outputted from the first diode D1 is VAA and the voltages VD2, VD3, VD4 outputted from the second diode D2, the third diode D3 and the fourth diode D4 are Vi+VAA.

In the fourth stage, the adjustable voltage source Vi is the high voltage level, at the time, the first diode D1 and the third diode D3 are turned off, the second diode D2 and the fourth diode D4 are turned on, the voltage VD1 outputted from the first diode D1 is Vi+VAA, the voltage VD2 outputted from the second diode D2 is Vi+VAA and the voltages VD3, VD4 outputted from the third diode D3 and the fourth diode D4 are 2Vi+VAA.

Therefore, a relationship between the input voltage VAA and an output voltage VGH meets with VGHF=VAA+2*Vi. When the selective voltage is different, the voltage Vi outputted from the adjustable voltage source is different and the output voltage VGH is different either.

With implementing the embodiment of the present invention, an output terminal can provide the different output voltages by inputting different voltages to the adjustable voltage source to meet with various client's requirements. And, different driving currents are provided by adjusting the voltages. When a large current is required to drive, the output voltage can be decreased to increase a current-driven capability.

Figure 3:
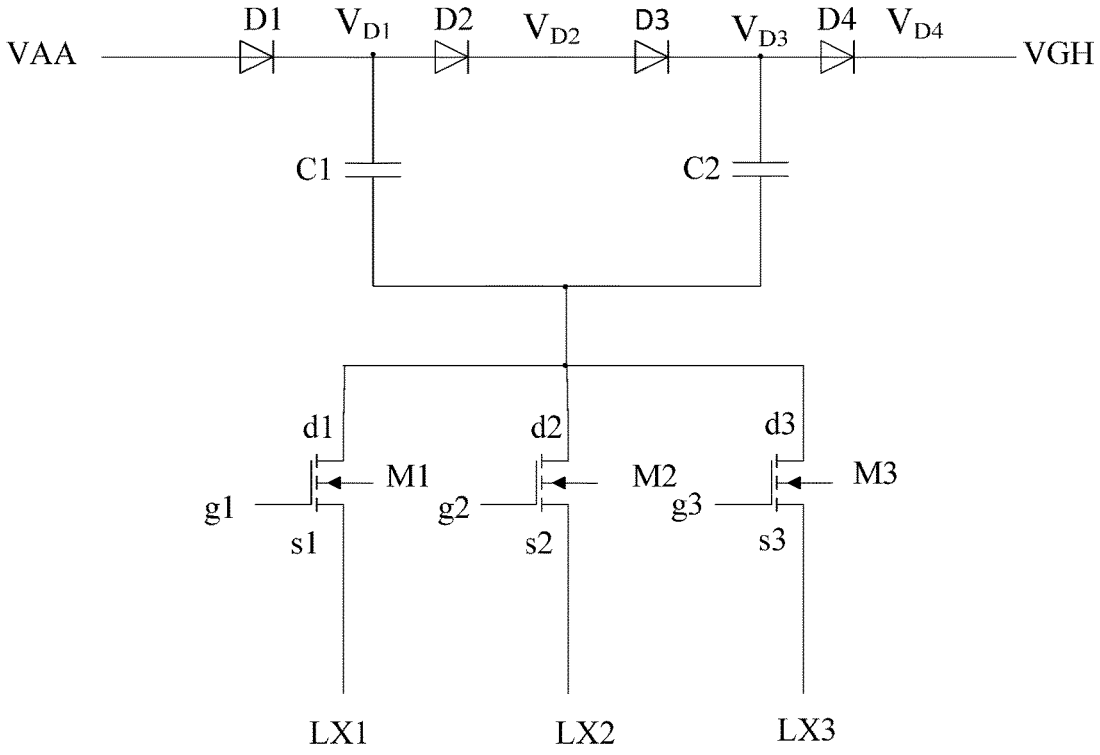
FIG. 3 is another circuit diagram of a driving circuit of the present invention.

Please refer to FIG. 3. FIG. 3 is a circuit diagram of another embodiment of the driving circuit of the present invention. The present embodiment of the driving circuit comprises: a first diode D1, a second diose D2, a third diode D3, a fourth diode D4, a first capacitor C1, a second capacitor C2, a first field-effect transistor (FET) M1, a second FET M2 and a third FET M3. Wherein, the first capacitor C1 and the second capacitor C2 are non-adjustable capacitors. An anode of the first diode D1 is used to input a voltage, a cathode of the first diode D1 is connected to an anode of the second diode D2, a cathode of the second diode D2 is connected to an anode of the third diode D3, a cathode of the third diode D3 is connected to an anode of the fourth diode D4, a cathode of the fourth diode D4 is used to output a voltage, a first end of the first capacitor C1 is connected to a common end of the first diode D1 and the second diode D2, a first end of the second capacitor C2 is connected to a common end of the third diode D3 and the fourth diode D4, a second end of the first capacitor C1 is connected to a second end of the second capacitor C2. A gate of the first FET M1 is used to input a first voltage, a drain d1 of the first FET M1 is connected to a common end of the second ends of the first and second capacitors C1, C2, a source s1 of the first FET M1 is used to input a first selective voltage LX1, a gate g2 of the second FET M2 is used to input a second voltage, a drain d2 of the second FET M2 is connected to the common end of the second ends of the first and second capacitors C1, C2, a source s2 of the second FET M2 is used to input a second selective voltage LX2, a gate g3 of the third FET M3 is used to input a third voltage, a drain d3 of the third FET M3 is connected to the common end of the second ends of the first and second capacitors C1, C2, a source s3 of the third FET M3 is used to input a third selective voltage LX3. Wherein, the first selective voltage LX1, the second selective voltage LX2 and the third selective voltage LX3 are pulse width modulation voltages with different duty ratios.

When the first voltage is inputted to the gate g1 of the first FET M1, no voltage is inputted to the gates g2, g3 of the second and third FETs M2, M3, the first FET M1 is turned on, so the first and second capacitors C1, C2 are charged by the first selective voltage LX1. A particular process is:

In a first stage, the first selective voltage LX1 is a low voltage level, at the time, the first diode D1, the second diode D2, the third diode D3 and the fourth diode D4 are turned on, and voltages VD1, VD2, VD3, VD4 outputted from the first diode D1, the second diode D2, the third diode D3 and the fourth diode D4 are VAA.

In a second stage, the first selective voltage LX1 is a high voltage level, the first diode D1 is turned off, the second diode D2, the third diode D3 and the fourth diode D4 are turned on, and the voltages VD1, VD2, VD3, VD4 outputted from the first diode D1, the second diode D2, the third diode D3 and the fourth diode D4 are LX1+VAA.

In a third stage, the first selective voltage LX1 is the low voltage level, at the time, the first diode D1 and the third diode D3 are turned on, the second diode D2 and the fourth diode D4 are turned off, the voltage VD1 outputted from the first diode D1 is VAA and the voltages VD2, VD3, VD4 outputted from the second diode D2, the third diode D3 and the fourth diode D4 are LX1+VAA.

In the fourth stage, the first selective voltage LX1 is the high voltage level, at the time, the first diode D1 and the third diode D3 are turned off, the second diode D2 and the fourth diode D4 are turned on, the voltage VD1 outputted from the first diode D1 is LX1+VAA, the voltage VD2 outputted from the second diode D2 is LX1+VAA and the voltages VD3, VD4 outputted from the third diode D3 and the fourth diode D4 are 2LX1+VAA.

When the second voltage is inputted to the gate g2 of the second FET M2, no voltage is inputted to the gates g1, g3 of the first and third FETs M1, M3, the second FET M2 is turned on, so the first and second capacitors C1, C2 are charged by the second selective voltage LX2. A particular process is:

In a first stage, the second selective voltage LX2 is the low voltage level, at the time, the first diode D1, the second diode D2, the third diode D3 and the fourth diode D4 are turned on, and voltages VD1, VD2, VD3, VD4 outputted from the first diode D1, the second diode D2, the third diode D3 and the fourth diode D4 are VAA.

In a second stage, the second selective voltage LX2 is the high voltage level, the first diode D1 is turned off, the second diode D2, the third diode D3 and the fourth diode D4 are turned on, and the voltages VD1, VD2, VD3, VD4 outputted from the first diode D1, the second diode D2, the third diode D3 and the fourth diode D4 are LX2+VAA.

In a third stage, the second selective voltage LX2 is the low voltage level, at the time, the first diode D1 and the third diode D3 are turned on, the second diode D2 and the fourth diode D4 are turned off, the voltage VD1 outputted from the first diode D1 is VAA and the voltages VD2, VD3, VD4 outputted from the second diode D2, the third diode D3 and the fourth diode D4 are LX2+VAA.

In the fourth stage, the second selective voltage LX2 is the high voltage level, at the time, the first diode D1 and the third diode D3 are turned off, the second diode D2 and the fourth diode D4 are turned on, the voltage VD1 outputted from the first diode D1 is LX2+VAA, the voltage VD2 outputted from the second diode D2 is LX2+VAA and the voltages VD3, VD4 outputted from the third diode D3 and the fourth diode D4 are 2LX2+VAA.

When the third voltage is inputted to the gate g3 of the third FET M3, no voltage is inputted to the gates g1, g2 of the first and second FETs M1, M2, the third FET M3 is turned on, so the first and second capacitors C1, C2 are charged by the third selective voltage LX2. A particular process is:

In a first stage, the third selective voltage LX3 is the low voltage level, at the time, the first diode D1, the second diode D2, the third diode D3 and the fourth diode D4 are turned on, and voltages VD1, VD2, VD3, VD4 outputted from the first diode D1, the second diode D2, the third diode D3 and the fourth diode D4 are VAA.

In a second stage, the third selective voltage LX3 is the high voltage level, the first diode D1 is turned off, the second diode D2, the third diode D3 and the fourth diode D4 are turned on, and the voltages VD1, VD2, VD3, VD4 outputted from the first diode D1, the second diode D2, the third diode D3 and the fourth diode D4 are LX3+VAA.

In a third stage, the third selective voltage LX3 is the low voltage level, at the time, the first diode D1 and the third diode D3 are turned on, the second diode D2 and the fourth diode D4 are turned off, the voltage VD1 outputted from the first diode D1 is VAA and the voltages VD2, VD3, VD4 outputted from the second diode D2, the third diode D3 and the fourth diode D4 are LX3+VAA.

In the fourth stage, the third selective voltage LX3 is the high voltage level, at the time, the first diode D1 and the third diode D3 are turned off, the second diode D2 and the fourth diode D4 are turned on, the voltage VD1 outputted from the first diode D1 is LX3+VAA, the voltage VD2 outputted from the second diode D2 is LX3+VAA and the voltages VD3, VD4 outputted from the third diode D3 and the fourth diode D4 are 2LX3+VAA.

Therefore, based on the foregoing description, when the input voltage VAA is not changed, the selective voltages are different and the output voltages VGH are different either.

In a particular embodiment, when the first selective voltage LX1 is a BOOST voltage of a pulse width modulation chip, the output voltage VGH is 16V. When the second selective voltage LX2 is a 3.3V Buck line voltage of the pulse width modulation chip, the output voltage VGH is 12V. When the third selective voltage LX3 is a 1.2V Buck line voltage of the pulse width modulation chip, the output voltage VGH is 3.3V.

It can understand that the above-mentioned embodiment uses the adjustable voltage source including three FETs as an example to describe. In another embodiment, the number of the FETs may be four or more and a particular number is decided according to needs.

With implementing the embodiment of the present invention, an output terminal can provide the different output voltages by inputting different voltages to the adjustable voltage source to meet with various client's requirements. And, different driving currents are provided by adjusting the voltages. When a large current is required to drive, the output voltage can be decreased to increase a current-driven capability.

The present invention provides a liquid crystal display panel. the panel comprises the driving circuit as shown in FIG. 2 and FIG. 3. Please refer to FIG. 2 and FIG. 3 and related descriptions and here not to describe repeatedly.

It is understandable in practical to the person who is skilled in the art that all or portion of the processes in the method according to the aforesaid embodiment can be accomplished with the computer program to instruct the related hardwares. The program can be stored in a readable storage medium of the computer. As the program is executed, the processes of the embodiments in the aforesaid respective methods can be included. The storage medium can be a hardisk, an optical disc, a Read-Only Memory (ROM) or a Random Access Memory (RAM).

The above disclosure is only a preferable embodiment of the present invention, it cannot be limit a claimed scope of the present invention. The person who is skilled in the art can understand and implement all or portion of the processes of the aforesaid embodiment and can equivalently modify according to claims of the present invention. Any modifications, equivalent replacements or improvements within the spirit and principles of the embodiment described above should be covered by the protected scope of the invention.

What is claimed is:

1. A driving circuit, characterized in that, the driving circuit comprises: a first diode, a second diode, a third diode, a fourth diode, a first capacitor, a second capacitor and an adjustable voltage source, wherein; an anode of the first diode is used to input an input voltage, a cathode of the first diode is connected to an anode of the second diode, a cathode of the second diode is connected to an anode of the third diode, a cathode of the third diode is connected to an anode of the fourth diode, a cathode of the fourth diode is used to output an output voltage, a first end of the first capacitor is connected to a common end of the first diode and the second diode, a first end of the second capacitor is connected to a common end of the third diode and the fourth diode, a second end of the first capacitor and a second end of the second capacitor are connected to an output terminal of the adjustable voltage source; and the adjustable voltage source comprises three field effect transistors (FET) including a first FET, a second FET and a third FET, wherein a gate of the first FET is used to input a first voltage, a drain of the first FET is connected to the output terminal, and a source of the first FET is used to input a first selective voltage, a gate of the second FET is used to input a second voltage, a drain of the second FET is connected to the output terminal, and a source of the second FET is used to input a second selective voltage; and a gate of the third FET is used to input a third voltage, a drain of the third FET is connected to the output terminal, and a source of the third FET is used to input a third selective voltage wherein the first selective voltage, the second selective voltage and the third selective voltage are pulse width modulation voltages with different duty ratios; when the input voltage is not changed, one of the first to third selective voltages is selected to output the output terminal and the output voltage is different, wherein, the first capacitor and the second capacitor are non-adjustable capacitors.

2. The circuit according to claim 1, characterized in that, when the first selective voltage is a BOOST voltage of a pulse width modulation chip, the output voltage is 16V; when the second selective voltage is a 3.3V Buck line voltage of the pulse width modulation chip, the output voltage is 12V; and when the third selective voltage is the 1.2V Buck line voltage of the pulse width modulation chip, the output voltage is 3.3V.

3. A liquid crystal display panel, characterized in that, the liquid crystal display panel comprises a driving circuit and the driving circuit comprises: a first diode, a second diode, a third diode, a fourth diode, a first capacitor, a second capacitor and an adjustable voltage source, wherein; an anode of the first diode is used to input an input voltage, a cathode of the first diode is connected to an anode of the second diode, a cathode of the second diode is connected to an anode of the third diode, a cathode of the third diode is connected to an anode of the fourth diode, a cathode of the fourth diode is used to output an output voltage, a first end of the first capacitor is connected to a common end of the first diode and the second diode, a first end of the second capacitor is connected to a common end of the third diode and the fourth diode, a second end of the first capacitor and a second end of the second capacitor are connected to an output terminal of the adjustable voltage source; and the adjustable voltage source comprises three field effect transistors (FET) including a first FET, a second FET and a third FET, wherein a gate of the first FET is used to input a first voltage, a drain of the first FET is connected to the output terminal, and a source of the first FET is used to input a first selective voltage, a gate of the second FET is used to input a second voltage, a drain of the second FET is connected to the output terminal, and a source of the second FET is used to input a second selective voltage; and a gate of the third FET is used to input a third voltage, a drain of the third FET is connected to the output terminal, and a source of the third FET is used to input a third selective voltage; wherein the first selective voltage, the second selective voltage and the third selective voltage are pulse width modulation voltages with different duty ratios; when the input voltage is not changed, one of the first to third selective voltages is selected to output the output terminal and the output voltage is different.

4. The liquid crystal display panel according to claim 3, characterized in that, when the first selective voltage is a BOOST voltage of a pulse width modulation chip, the output voltage is 16V; when the second selective voltage is a 3.3V Buck line voltage of the pulse width modulation chip, the output voltage is 12V; and when the third selective voltage is the 1.2V Buck line voltage of the pulse width modulation chip, the output voltage is 3.3V.

5. The liquid crystal display panel according to claim 3, characterized in that, the first capacitor and the second capacitor are non-adjustable capacitors.

* * * * *